US008473117B1

(12) United States Patent
McConville

(10) Patent No.: US 8,473,117 B1
(45) Date of Patent: Jun. 25, 2013

(54) FLIGHT CONTROL SYSTEM FOR A MODEL AIRCRAFT

(75) Inventor: Michael J. McConville, Monticello, IL (US)

(73) Assignee: Horizon Hobby, Inc., Champaign, IL (US)

( * ) Notice: Subject to any disclaimer, the term of this patent is extended or adjusted under 35 U.S.C. 154(b) by 240 days.

(21) Appl. No.: 13/104,419

(22) Filed: May 10, 2011

(51) Int. Cl.
*G06F 17/00* (2006.01)
*G06F 19/00* (2006.01)

(52) U.S. Cl.
USPC ..... 701/2; 701/10; 701/12; 244/12.4

(58) Field of Classification Search
USPC ..... 701/2, 6, 12, 10; 244/12.4, 17.25
See application file for complete search history.

(56) References Cited

U.S. PATENT DOCUMENTS 6,655,631 B2 * 12/2003 Austen-Brown ..... 244/12.4
7,448,571 B1 * 11/2008 Carter et al. ..... 244/17.25
2006/0212182 A1 * 9/2006 Shaw ..... 701/12

OTHER PUBLICATIONS

McConville, Mike, "How to program like a Pro", INDY Quarterly, vol. 76, Fall 1998.

* cited by examiner

*Primary Examiner* — Tan Q Nguyen
(74) *Attorney, Agent, or Firm* — Suiter Swantz pc llo

(57) ABSTRACT

A flight control system and method for controlling the flight of a fixed-wing model aircraft is disclosed. The flight control system may actively sense the condition when the wings of the model aircraft are not level to the horizon. The flight control system may then command the servo(s) to control movement about the roll and the yaw axes of the aircraft in order to level the wings to the horizon. In addition, the flight control system may limit the maximum bank angle that can be achieved even when full roll control is commanded by the operator. The flight control system in accordance with the present disclosure may allow inexperienced operators to fly model aircraft successfully by eliminating/mitigating adverse effects that may cause the operators to lose control.

17 Claims, 6 Drawing Sheets

FLIGHT CONTROL SYSTEM FOR A MODEL AIRCRAFT

TECHNICAL FIELD

The disclosure generally relates to the field of remote controlled model aircrafts, particularly to a flight control system for a model aircraft.

BACKGROUND

Radio control (RC) technologies may be utilized for controlling flight of model aircrafts. For instance, fixed-wing model aircrafts may be controlled utilizing such RC controllers, which allow users to control flight of the aircrafts from remote locations (e.g., on the ground). However, learning to operate/fly such model aircrafts from remote locations may require practice, and inexperienced operators may be affected by adverse effects such as disorientation, lack of perspective or the like. For example, an inexperienced operator may fail to release control input for the roll or turn command, which may put the model aircraft in a spiral, spin or unwanted inverted attitude. Therefore, systems/methods are needed to aid inexperienced operators to learn to operate/fly model aircrafts from remote locations.

SUMMARY

The present disclosure is directed to a flight control system and method for controlling the flight of a fixed-wing model aircraft. The flight control system may actively sense the condition when the wings of the model aircraft are not level to the horizon. The flight control system may then command the servo(s) to control movement about the roll and the yaw axes of the aircraft in order to level the wings to the horizon. In addition, the flight control system may limit the maximum bank angle that can be achieved even when full roll control is commanded by the operator. The flight control system in accordance with the present disclosure may allow inexperienced operators to fly model aircraft successfully by eliminating/mitigating adverse effects that may cause the operators to lose control.

The flight control system may include a wing leveling module for leveling wings of the model aircraft with respect to a horizontal plane. The wing leveling module may include a gyroscope mounted on the model aircraft. The gyroscope includes a spin axis positioned in a plane defined by the roll axis and the yaw axis of the model aircraft and is offset by a predetermined angle from the yaw axis. The gyroscope is configured for detecting a condition when the wings of the model aircraft are not level to the horizontal plane, and the gyroscope is further configured for controlling movement of the model aircraft with respect to at least one of the roll axis or the yaw axis.

The flight control system may also include a bank angle limiting module for conditionally reducing a response rate for a roll command. The bank angle limiting module may include a deflection determination module for determining a percentage of deflection of a control stick that provides the roll command. The bank angle limiting module further includes a timing module for determining a time delay at least partially based on the percentage of deflection of the control stick and a rate reduction module for reducing the response rate for the roll command when the percentage of deflection of the control stick is maintained after the time delay has elapsed.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

The present disclosure is directed to a flight control system and method for controlling the flight of a fixed-wing model aircraft. Such a flight control system may be appreciated by inexperienced operators learning to operate/fly model aircrafts. The flight control system may actively sense the condition when the wings of the model aircraft are not level to the horizon. The flight control system may then command the servo(s) to control movement about the roll and the yaw axes of the aircraft in order to level the wings to the horizon. In addition, the flight control system may limit the maximum bank angle that can be achieved even when full roll control is commanded by the operator (e.g., the control stick for the roll command is fully deflected/engaged on the controller). The flight control system in accordance with the present disclosure may allow inexperienced operators to fly model aircraft successfully by eliminating/mitigating adverse effects that may cause the operators to lose control.

Figure 1:
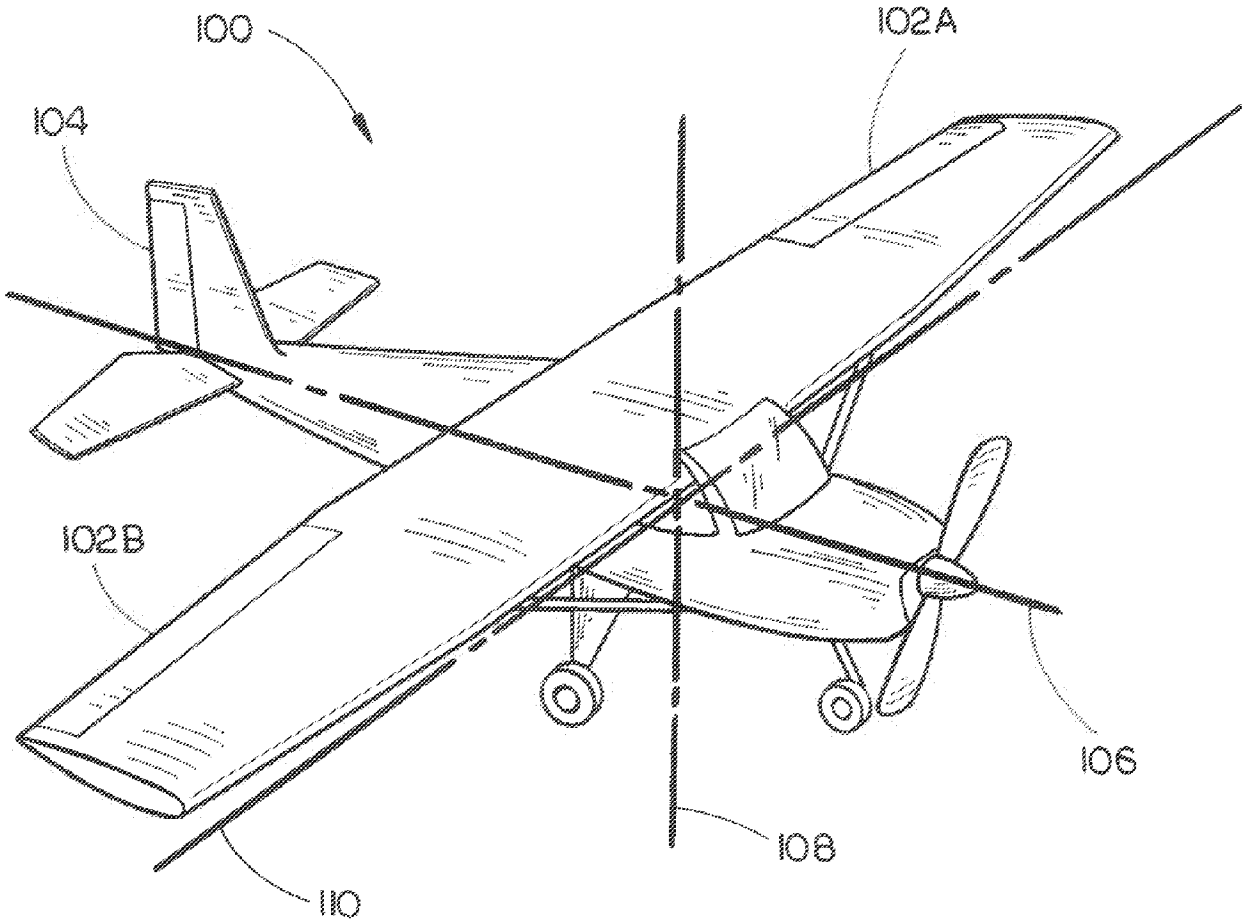
FIG. 1 is an isometric view of an exemplary fix-wing model aircraft.

Referring FIG. 1, an exemplary fixed-wing model aircraft 100 is shown. The model aircraft 100 may include one or more control surfaces mechanically controlled by one or more servos. Such control surfaces may include ailerons 102, rudders 104, elevators, flaps, or the like. While the specific types of control surfaces utilized by different model aircrafts may vary, their purposes are to control movements of the model aircraft 100 during flight. For instance, the model aircraft 100 may rotate about the three axes indicated in FIG. 1. The three axes are conventionally referred to as the roll axis 106, the yaw axis 108, and the pitch axis 110.

The flight control system in accordance with the present disclosure may include a wing leveling module. The wing leveling module may sense the condition when the wings of the model aircraft are not level to the horizon. When such a condition occurs, the wing leveling module may adjust the control surfaces (e.g., ailerons, rudders or the like) to control movements of the model aircraft 100 about the roll axis 106 and the yaw axis 108 in order to level the wings.

Figure 2:
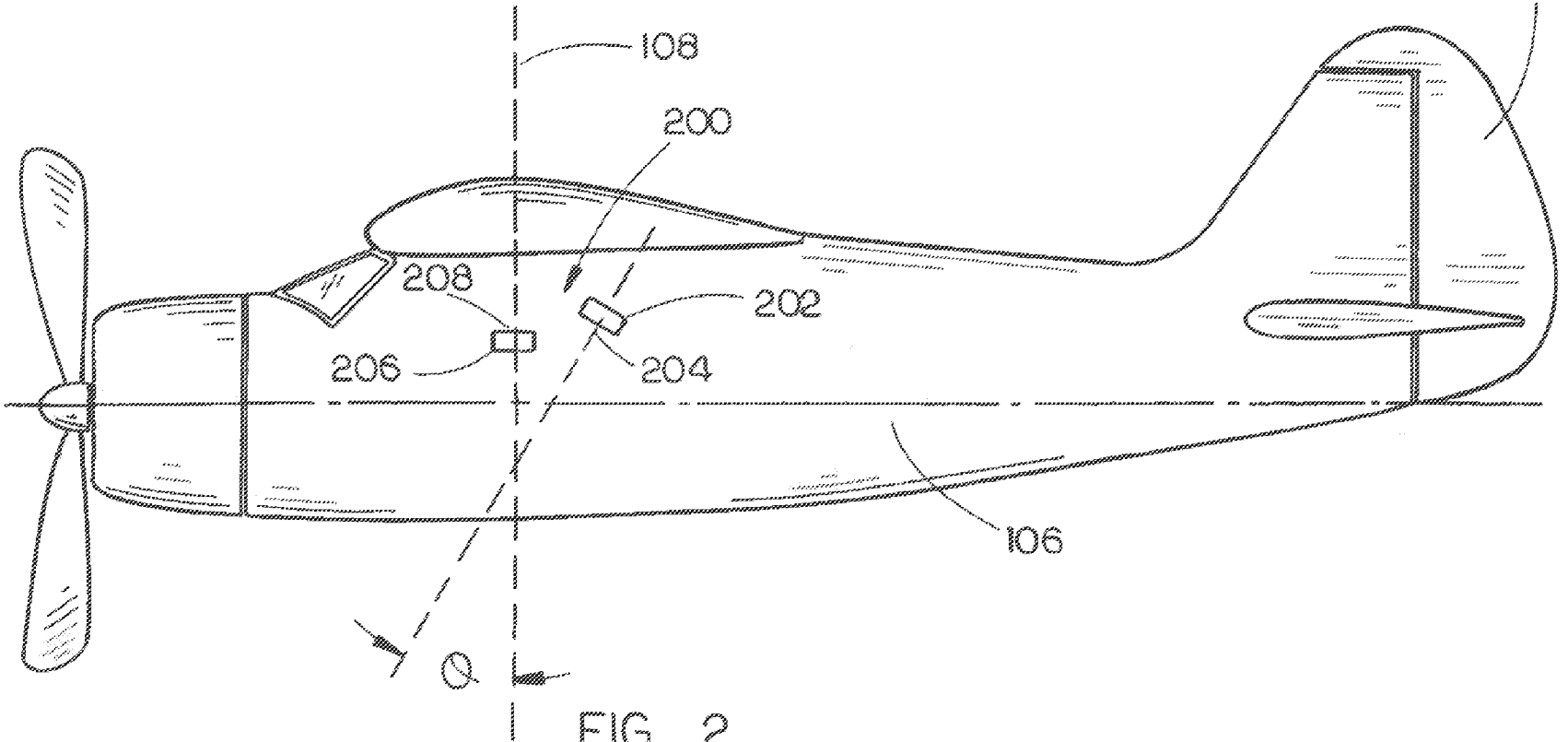
FIG. 2 is an illustration depicting a wing leveling module installed in a model aircraft.
Figure 3:
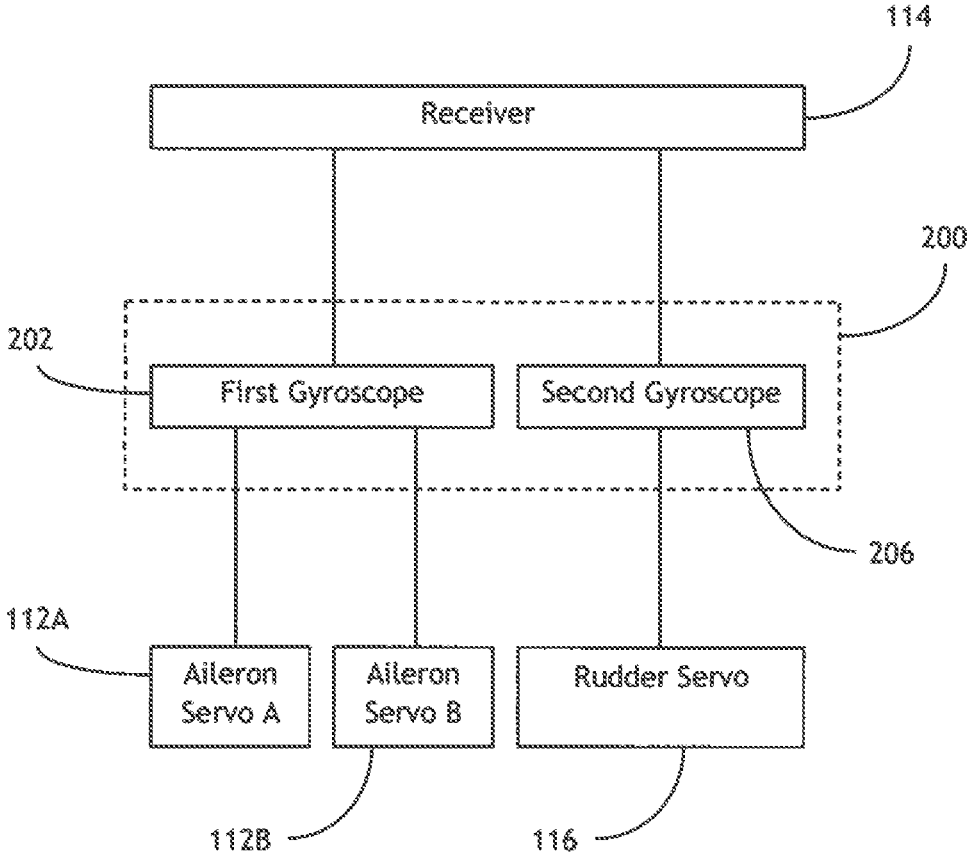
FIG. 3 is a block diagram of a wing leveling module for a model aircraft.

FIGS. 2 and 3 illustrate an exemplary wing leveling module 200 in accordance with the present disclosure. The wing leveling module 200 may include a gyroscope 202 installed on the model aircraft 100. The spin axis 204 of the gyroscope 202 is positioned in the plane defined by the roll axis 106 and the yaw axis 108 of the model aircraft. Furthermore, the spin axis 204 of the gyroscope 202 is offset by a predetermined angle θ (e.g., 30°) from the yaw axis 108. That is, the gyroscope 202 is mounted at an angle that is not directly on the roll axis 106 or the yaw axis 108 of the aircraft. Rather, it is installed at an angle between the two axes 106 and 108. In this manner, the gyroscope 202 may be sensitive to movements with respect to both the roll axis 106 and the yaw axis 108, and therefore may be able to more accurately detect the condition when the wings of the model aircraft are not level to the horizon.

When the gyroscope 202 detects that the wings of the model aircraft are not level to the horizon, the gyroscope 202 may provide signals to control the movement of the model aircraft 100 until the wings are leveled. For instance, the gyroscope 202 may be communicatively connected with aileron servos 112A and 112B that control the ailerons 102A and 102B, respectively. The gyroscope 202 may indicate to the aileron servos 112A and 1126 the difference between the orientations of the wings with respect to the horizon. The aileron servos 112A and 112B may then adjust the positions of their corresponding ailerons 102A and 102B, which in turn may rotate the model aircraft 100 about the roll axis 106 and/or the yaw axis 108 until the wings are leveled.

It is contemplated that various techniques may be utilized for determining the intensity of adjustments to be applied to the ailerons 102. For instance, a relatively small adjustment may be continuously applied to the ailerons 102 in order to rotate the model aircraft 100 smoothly until the wings are leveled. Alternatively, the amount of adjustment to be applied to the ailerons 102 may be determined based on the difference between the orientations of the wings with respect to the horizon. For example, greater adjustments may be applied if such differences are above a certain threshold. It is understood that other techniques for determining the intensity of adjustments to be applied to the ailerons 102 may be utilized without departing from the spirit and scope of the present disclosure.

It is also contemplated that certain model aircrafts may utilize control surfaces such as rudders to control the yaw of the aircrafts. The wing leveling module 200 utilized in such a model aircraft may therefore include a second gyroscope 206. The spin axis 208 of the second gyroscope 206 may also be positioned in the plane defined by the roll axis 106 and the yaw axis 108 of the model aircraft. However, different from the first mentioned gyroscope 202, the spin axis 208 of the second gyroscope 206 may be positioned on the yaw axis 108. The second gyroscope 206 may be communicatively connected with a rudder servo 116 that controls the rudder 104. The second gyroscope 206 may indicate to the rudder servo 116 when the yaw axis of the model aircraft is not perpendicular to the horizon, and the rudder servo 116 may then adjust the rudder 104 accordingly to rotate the model aircraft 100 to provide a more coordinated and smooth movement as the model aircraft 100 rolls back to level position.

The ability to control the rudder 104 for wing leveling purposes may also be appreciated in 3-channel model aircrafts. A 3-channel model aircraft may refer to a model aircraft having aerodynamic design such that the rudder is used to control both the roll and raw axes of the aircraft simultaneously. The wing leveling module utilized in such a model aircraft may utilize the signals provided from the first gyroscope 202, the second gyroscope 206 or the combination of the signals from these gyroscopes to indicate to the rudder servo 116 when the wings of the model aircraft is not leveled, and the rudder servo 116 may then adjust the rudder 104 accordingly to rotate the model aircraft about its roll axis and/or its yaw axis until the wings are leveled.

It is further contemplated that the amount of signal gains and/or sensitivities associated with the first gyroscope 202 and the second gyroscope 206 may be tuned/optimized for each particular model in order to provide the desired rate of roll back to wing level. Furthermore, various types of gyroscopes may be utilized without departing from the spirit and scope of the present disclosure. Exemplary gyroscopes may include mechanical or solid state gyroscopes. Solid state gyroscopes may be discrete sensors of multi axis sensor packages.

It is also contemplated that the wing leveling module 200 may be conditionally engaged based on the control signals received at the receiver 114 located on the model aircraft 100. For instance, the wing leveling module 200 may be engaged based on a rollback command. The rollback command may be triggered by the operator utilizing a controller button or a combination of buttons. Alternatively, the wing leveling module 200 may be engaged when no roll or turn command is received at the receiver 114. In this manner, the operator may simply release the control stick for controlling the roll or turn of the aircraft, and the wing leveling module 200 may be automatically engaged to roll back the wings of the aircraft 100 to a leveled position.

Furthermore, the wing leveling module 200 may be utilized to modify the control signals received at the receiver 114. That is, the wing leveling module 200 may receive the control signals from the receiver 114 and conditionally modify the control signals before providing the signals to the servos. Such conditional adjustments may be provided, for example, when the wing leveling module 200 detects that the difference between the orientations of the wings with respect to the horizon is above a predetermined threshold. In such cases, the wing leveling module 200 may modify the control signals to reduce/limit the amount of roll or turn originally commanded by the operator.

The flight control system in accordance with the present disclosure may also include a bank angle limiting module. The bank angle limiting module may conditionally reduce a response rate to a command issued by the operator. For example, the operator may issue a roll command using the controller. Upon receiving the roll command, the ailerons 102 of the model aircraft 100 may deflect accordingly to rotate the aircraft 100 about its roll axis 106. However, an inexperienced operator may issue the roll command for too long, which may put the model aircraft 100 in a spiral, spin or unwanted inverted attitude. Therefore, conditionally reducing the deflection rates of the ailerons in response to the roll command may be appreciated.

Figure 4:
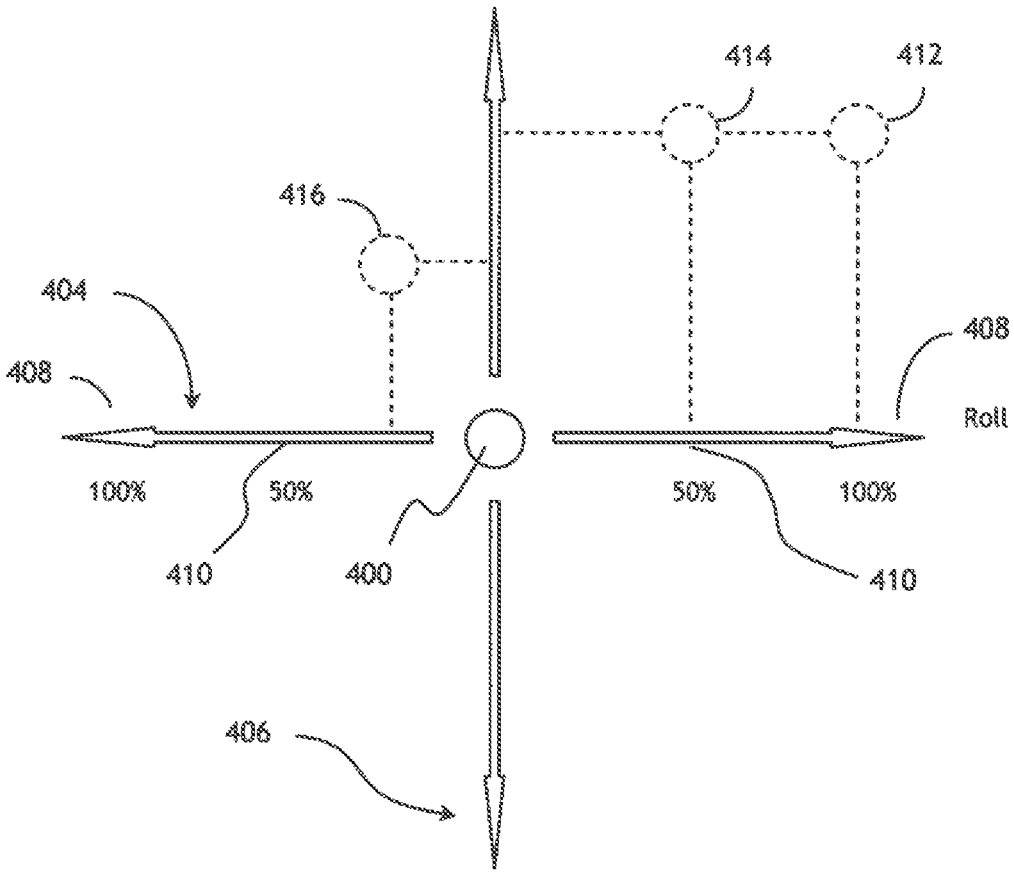
FIG. 4 is an illustration depicting the movement of a control stick.

FIG. 4 is an illustration depicting a control stick 400 of a controller. The control stick 400 may be movable with respect to a first axis 404 and a second axis 406. In one embodiment, the first axis 404 may correspond to the x-direction when the control stick 400 is being occupied by an operator (e.g., side-to-side movements of the control stick) and the second axis 406 may correspond to the y-direction when the control stick 400 is being occupied by the operator (e.g., up-and-down movements of the control stick).

For illustrative purposes, suppose that the roll command is controlled by the side-to-side movements of the control stick 400. For instance, the operator may command the aircraft 100 to roll in the clockwise direction by deflecting the control stick 400 to the right or in the counterclockwise direction by deflecting the control stick 400 to the left. The roll command issued by the operator may then be transmitted to the receiver 114 located on the model aircraft 100, and the control surfaces (e.g., ailerons 102) of the model aircraft 100 may be deflected accordingly to change the movement of the model aircraft 100.

When the controller is operated by an inexperienced operator, the operator may deflect the control stick 400 to issue a roll command but may over-deflect the control stick 400 or fail to release the control stick 400 in a timely manner. This may let the controller to send a continuous roll command to the receiver 114, which may deflect the control surfaces (e.g., ailerons 102) of the model aircraft 100 for too long and cause the bank angle of the model aircraft 100 to change more than that was intended by the operator. To help the inexperienced operator operating the model aircraft 100, the bank angle limiting module of the present disclosure may be utilized. For example, the control surfaces (e.g., ailerons 102) of the model aircraft 100 may be made less responsive to the continuous roll command after a period time.

Figure 5:
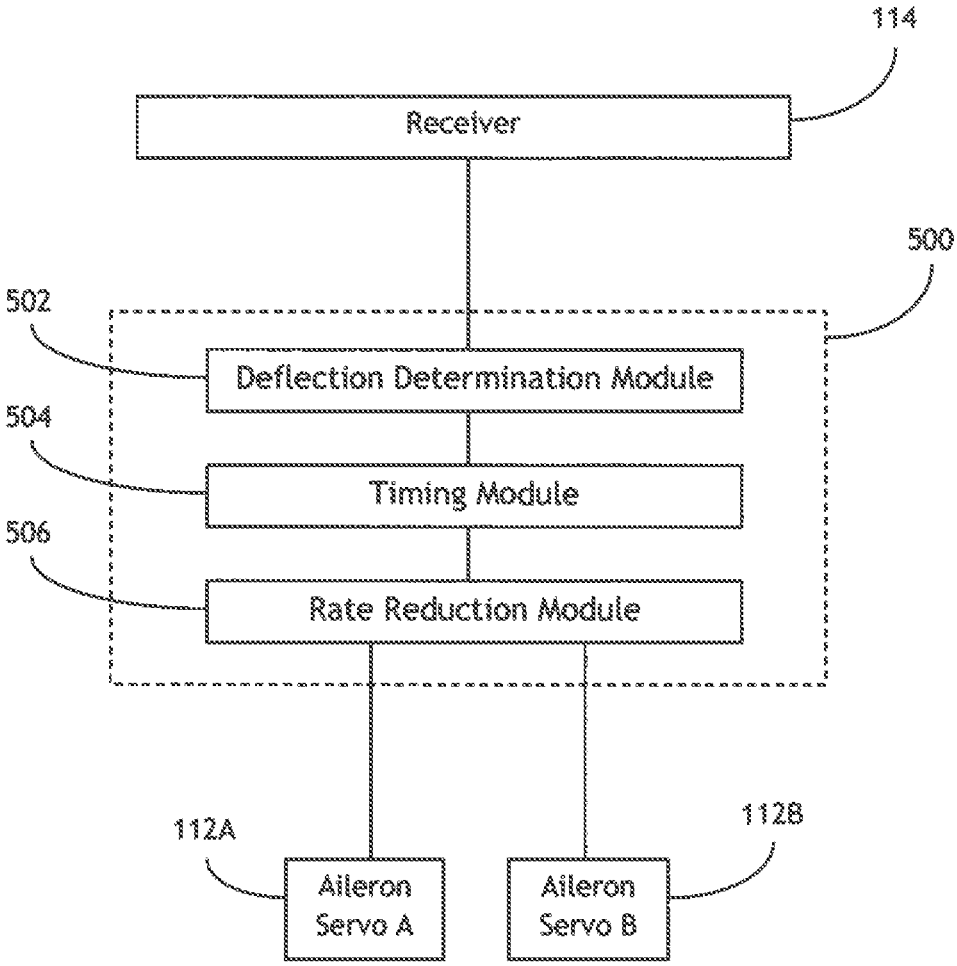
FIG. 5 is a block diagram of a bank angle limiting module for a model aircraft.

FIG. 5 illustrates an exemplary bank angle limiting module 500 in accordance with the present disclosure. The bank angle limiting module 500 may include a deflection determination module 502 configured to determine the percentage of deflection of the control stick 400 with respect to the direction that controls the roll of the aircraft (the first axis 404 in the example above). For example, the deflection determination module 502 may be located on the model aircraft 100 and may receive the position of the control stick 400 via the receiver 114. The deflection determination module 502 may then determine the percentage of deflection of the control stick 400 based on the position of the control stick 400. Alternatively, the controller may determine the percentage of deflection locally and communicate the information to the deflection determination module 502 via the receiver 114.

The percentage of deflection of the control stick 400 may range between 0% (at the neutral stick position) and 100% (at the fully deflected positions 408). For example, if the control stick 400 is deflected to location 412, the percentage of deflection of the control stick 400 with respect to the first axis 404 may be at 100% (fully deflected). In another example, if the control stick 400 is deflected to location 414, the percentage of deflection of the control stick 400 with respect to the first axis 404 may be at 50% (half deflected). In still another example, if the control stick 400 is deflected to location 416, the percentage of deflection of the control stick 400 with respect to the first axis 404 may be at 25%. Percentage of deflections with respect to the first axis 404 when the control stick 400 is at other locations may be determined similarly.

The bank angle limiting module 500 may also include a timing module 504 for determining a time delay. The time delay may be determined based on the percentage of deflection of the control stick. In one embodiment, the time delay is inversely proportional to the percentage of deflection of the control stick, determined based on equation:

$$\text{predetermined delay} \div \text{percentage of deflection}$$

where the predetermined delay is the predetermined time delay to be applied when the control stick 400 is at fully deflected positions such as positions 408, and the percentage of deflection is the percentage of deflection of the control stick 400.

The bank angle limiting module 500 may further include a rate reduction module 506 for reducing the response rate for the roll command if the percentage of deflection of the control stick is maintained after the time delay has elapsed. For example, suppose the time delay to be applied when the control stick 400 is at a fully deflected position is one second. If the operator fully deflects the control stick 400 and holds the control stick 400 at the fully deflected position (e.g., fully deflected to the right or the left) for more than one second, the ailerons 102 may respond to the roll command as they normally would for the first second, but they may respond to the roll command at a reduced rate (e.g., 33% of the normal level) after the first second. That is, while the controller may still send the same roll command to the receiver 114, the actual amount of deflections of the control surfaces (e.g., ailerons 102) in response to the roll command may be reduced after the time delay has elapsed (one second in this example). In this manner, even if the operator fails to release the control stick 400 from the deflected position, the reduced response rate may help limiting the bank angle of the model aircraft 100 and prevent it from losing control.

In another example, if the operator only deflected the control stick 400 half way to the fully deflected position (e.g., half deflected to the right or the left, denoted as positions 410), the time delay to be applied in this case may be determined as $1 \div 50\% = 2$ seconds. In this manner, the bank angle limiting module 500 may allow the operator to deflect and hold the control stick 400 at the half way position for 2 seconds before the response rate to the roll command is reduced. The response rate may return to the normal level once the control stick is returned to the neutral position, and the bank angle limiting module 500 may not need to be engaged when the control stick is at the neutral position.

It is contemplated that the predetermined time delay to be applied when the control stick 400 is at fully deflected positions may vary based on each particular model aircraft. In addition, the reduction in the response rate may also vary and/or may be user-configurable without departing from the spirit and scope of the present disclosure. Furthermore, the equation for determining the time delay described above is merely exemplary. The time delay may be determined utilizing various other equations as long as they are at least partially based on the percentage of deflection (or the position) of the control stick.

Figure 6:
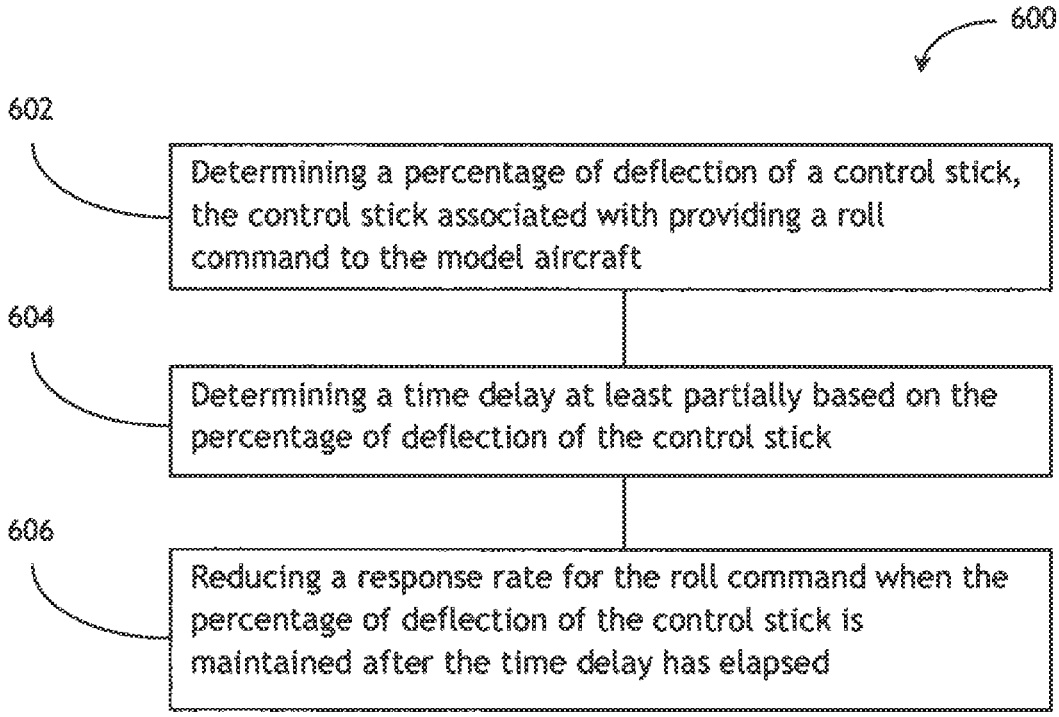
FIG. 6 is a flow diagram illustrating a bank angle limiting method.

Referring now to FIG. 6, there is shown a flow diagram illustrating steps performed by a bank angle limiting method 600 in accordance with the present disclosure. Step 602 may determine a percentage of deflection of a control stick that is associated with providing a roll command to the model aircraft. Step 604 may determine a time delay at least partially based on the deflection angle of the control stick as previously described. If the percentage of deflection of the control stick is maintained after the time delay has elapsed, step 606 may then reduce the response rate of the control surfaces responding to the roll command as previously described.

It is contemplated that while the bank angle limiting module and method described above are directed to conditionally reducing response rate associated with the roll command, similar response limiting modules/methods may be utilized for other commands (e.g., pitch command or the like) without departing from the spirit and scope of the present disclosure. In addition, the bank angle limiting module and the wing leveling module may be implemented as an integrated flight control system on board the model aircraft. Both modules may be configured such that they are ready for use without any tuning needed by the operator.

Furthermore, the flight control system of the present disclosure may be configured to be compatible with existing RC controllers. That is, the receiver of the model aircraft may provide all input signals needed by the flight control system; the communication channels between the controller and the receiver of the model aircraft may remain unchanged. The flight control system of the present disclosure may also be installed in existing model aircrafts and serve as stabilization systems. The system may actively dampen movement of the aircraft and thus minimizes the effects of external forces such as wind, thermals and wind shear on the track of the aircraft.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the disclosure. The accompanying method claims present elements of the various steps in a sample order, and are not necessarily meant to be limited to the specific order or hierarchy presented.

It is believed that the system and method of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. A flight control system for a fixed-wing model aircraft, the flight control system comprising:

a wing leveling module for leveling wings of the model aircraft with respect to a horizontal plane, the wing leveling module comprising:

a gyroscope mounted on the model aircraft, the gyroscope having a spin axis, the spin axis is positioned in a plane defined by a roll axis and a yaw axis of the model aircraft and is offset by a predetermined angle from the yaw axis, the gyroscope is configured for detecting a condition when the wings of the model aircraft are not level to the horizontal plane, and the gyroscope is further configured for controlling movement of the model aircraft with respect to at least one of the roll axis or the yaw axis; and a bank angle limiting module for conditionally reducing a response rate for a roll command, the bank angle limiting module comprising:

a deflection determination module for determining a percentage of deflection of a control stick, the control stick associated with providing the roll command;

a timing module for determining a time delay at least partially based on the percentage of deflection of the control stick; and a rate reduction module for reducing the response rate for the roll command when the percentage of deflection of the control stick is maintained after the time delay has elapsed.

2. The flight control system of claim 1, wherein the spin axis of the gyroscope is offset by approximately 30° from the yaw axis.

3. The flight control system of claim 1, wherein the movement of the model aircraft with respect to the roll axis is controlled utilizing a plurality of ailerons.

4. The flight control system of claim 1, wherein the wing leveling module further comprises:

a second gyroscope mounted on the model aircraft, the second gyroscope having a spin axis positioned on the yaw axis of the model aircraft, the second gyroscope is configured for controlling a rudder of the aircraft when the yaw axis of the model aircraft is not perpendicular to the horizontal plane.

5. The flight control system of claim 4, wherein the movement of the model aircraft with respect to at least one of the roll axis or the yaw axis is controlled utilizing the rudder.

6. The flight control system of claim 1, wherein the time delay is inversely proportional to the percentage of deflection of the control stick.

7. The flight control system of claim 1, wherein a rate reduction module is configured to reduce an amount of deflection to be applied to at least one aileron of the model aircraft.

8. A flight control system for a fixed-wing model aircraft, the flight control system comprising:

a receiver located on the model aircraft, the receiver is configured for receiving a control signal;

a first gyroscope communicatively connected to the receiver, the first gyroscope having a spin axis, the spin axis is positioned in a plane defined by a roll axis and a yaw axis of the model aircraft and is offset by a predetermined angle from the yaw axis, the first gyroscope is configured for detecting a condition when wings of the model aircraft are not level to a horizontal plane, the first gyroscope is further configured for providing a modified control signal based on the condition detected; and at least one servo communicatively connected to the first gyroscope, the at least one servo is configured for receiving the modified control signal from the first gyroscope, the at least one servo is further configured for controlling movement of the model aircraft with respect to at least one of the roll axis or the yaw axis based on the modified control signal received from the first gyroscope.

9. The flight control system of claim 8, wherein the spin axis of the first gyroscope is offset by approximately 30° from the yaw axis.

10. The flight control system of claim 8, wherein the at least one servo is configured to control an aileron of the model aircraft.

11. The flight control system of claim 8, wherein the at least one servo is configured to control a rudder of the model aircraft.

12. The flight control system of claim 8, further comprising:

a second gyroscope communicatively connected to the receiver, the second gyroscope having a spin axis positioned on the yaw axis of the model aircraft, the second gyroscope is configured for detecting a condition when the yaw axis of the model aircraft is not perpendicular to the horizontal plane, the second gyroscope is further configured for providing another modified control signal based on the condition detected; and a rudder servo communicatively connected to the second gyroscope, rudder servo is configured for receiving the modified control signal from the second gyroscope, the rudder servo is further configured for controlling a rudder of the model aircraft based on the modified control signal received from the second gyroscope.

13. A bank angle limiting method for a fixed-wing model aircraft, the method comprising:

determining a percentage of deflection of a control stick;

determining a time delay at least partially based on the percentage of deflection of the control stick; and conditionally reducing a response rate for a command generated by the control stick, the response rate for the command is reduced when the percentage of deflection of the control stick is maintained after the time delay has elapsed.

14. The bank angle limiting method of claim 13, wherein the time delay is inversely proportional to the percentage of deflection of the control stick.

15. The bank angle limiting method of claim 13, wherein the command generated by the control stick is a roll command.

16. The bank angle limiting method of claim 15, wherein reducing the response rate for the roll command further comprising:

reducing an amount of deflection to be applied to at least one aileron of the model aircraft.

17. The bank angle limiting method of claim 13, further comprising:

resetting the response rate for the command to a normal level when the control stick is returned to a neutral position.

* * * * *